US005747713A

United States Patent [19]

Clement

[11] Patent Number: 5,747,713

[45] Date of Patent: May 5, 1998

[54] TREMOLO

[76] Inventor: Andrew Clement, Box 20, 30 Route 257, Gould, Quebec, Canada, J0B 2Z0

[21] Appl. No.: 884,020

[22] Filed: Jun. 27, 1997

Related U.S. Application Data

[63] Continuation of Ser. No. 499,518, Nov. 10, 1995, abandoned, which is a continuation of Ser. No. 116,570, Sep. 7, 1993, abandoned.

[51] Int. Cl.[6] ..... G10D 3/12

[52] U.S. Cl. ..... 84/313

[58] Field of Search ..... 84/313

[56] References Cited

U.S. PATENT DOCUMENTS 4,724,737 2/1988 Fender ..... 84/313

4,903,568 2/1990 Itoh ..... 84/313

*Primary Examiner*—Cassandra C. Spyrou

*Attorney, Agent, or Firm*—Eric Fincham

[57] ABSTRACT

There is provided a tremolo device for use with a stringed musical instrument wherein the tension in the string is not directly balanced by a spring, but rather a lever riding on a cam surface having a varying curve such that any change in the pull tension on the strings has a minimal effect on the tuning of the instrument.

8 Claims, 2 Drawing Sheets

TREMOLO

This is a continuation of application Ser. No. 08/449,518 filed Nov. 10, 1995, now abandoned, which is a continuation of application Ser. No. 08/116,570 filed Sep. 7, 1993, now abandoned.

BACKGROUND OF THE INVENTION

The present invention relates to a tremolo device for use with a stringed musical instrument and more particularly, relates to a new concept in a tremolo device.

Tremolo devices for stringed instruments are widely known and used. They are frequently used on electric guitars and are employed to either reduce or increase tension on the strings of the musical instrument to produce certain desired musical effects. Examples of such tremolo devices may be found in, for example, U.S. Pat. No. 4,882,967 to Rose; U.S. Pat. No. 2,972,923 to Fender; and U.S. Pat. No. 4,555,970 to Rose.

As described in these patents, a typical tremolo is used with an electric guitar which has a body and a neck with a plurality of strings, each string being attached adjacent to one end of the neck and extending rearwardly to and over a portion of the body of the guitar to the tremolo to which it is attached. The strings are attached to a portion of the tremolo which is moveable such that the user of the guitar may either increase or decrease the tension on the springs to move the tone of the guitar in the sharp or flat direction respectively. Typically, prior art tremolos utilize a plate or bar to which the strings are attached and which plate or bar is pivotable to provide the necessary movement to increase/decrease the string tension. In the neutral position, the tremolo device usually uses a balancing of forces between string tension and springs which are attached to the bar or plate. Thus, when one wants to decrease the tension on the strings, one must pivot the plate or bar against the spring pressure. In order to increase the tension on the strings, one pivots the bar or plate in the other direction against the tension on the strings with the spring means being employed to return the bar or plate to the neutral position when use of the tremolo is finished.

Various problems can arise with the use of tremolos and indeed these problems are well known in the art and have been addressed in the patent literature. Some of the problems include the fact that should one of the strings of the guitar break during a performance, the balance existing between the total tension of the unbroken strings and the bias of the springs is changed and thus the bar or base plate will pivot until the tension in the remaining unbroken strings counterbalances the spring bias. This naturally results in an instrument which is out of tune.

Also, on conventional tremolos, the strings are held at approximately the same distance from the fulcrum which results in a discordant effect when the tremolo is operated with more than one string in play as different gauge strings do not descend in pitch directly proportional to the distance travelled.

It is also known that the bias of the springs will change with changes in the ambient temperature and thus, a problem is encountered when the temperature changes during a performance. Any change in temperature may thus require a re-tuning of the instrument.

Furthermore, when one balances the tension in the strings by spring means, there is a certain loss of "punch and edge" in tone compared to fixed bridge instruments. This is due to the fact that any change in the tension of the string while using the instrument is balanced by spring tension. Naturally, there is a certain "give" in the spring and the resultant change in the tone of the instrument.

Still further, use of a technique such as string bending by the fingering hand can affect the fine balance between the string tension and the spring bias.

SUMMARY OF THE INVENTION

It is an object of the present invention to provide a tremolo of a fixed bridge type wherein the tension in the strings is not counterbalanced by spring bias.

It is a further object of the present invention to provide a tremolo which will not be displaced from its neutral position by string tension changes.

It is a further object of the present invention to provide a tremolo wherein, when the tremolo is utilized, a plurality of strings operate to maintain the chord as it ascends or descends in pitch.

According to one aspect of the present invention, there is provided a tremolo device for use with a musical instrument having a plurality of strings, the device comprising a housing having a first pivotal member which is rotatably mounted. There are means on the first pivotal member for receiving and mounting an end of one string thereon such that a pivotable movement in a first direction will cause an increase in tension on the string and a pivotable movement in a second direction will allow for a decrease in tension on the string. The first pivotable member has a cam surface associated therewith, the cam surface having a center point and an upwardly extending cam surface portion having a decreasing radius on one side of the center point and a downwardly extending cam surface portion having an increasing radius on a second side of the center point. A second pivotable member is mounted on a shaft and is also pivotable with respect to the housing and has an arm extending outwardly therefrom which is adapted to contact the cam surface and to move therealong. Spring means are associated with the second pivotable member.

In a further aspect of the present invention, there is provided a tremolo device for use with a musical instrument having a plurality of strings, the device having a housing and a first pivotable member with means thereon for mounting one end of the strings. The first pivotable member is pivotable in a first direction to increase tension on the strings and pivotable in a second direction to decrease tension on the strings. A bridge saddle is mounted proximate one end of the housing and the means for mounting the one end of the string are in a staggered relationship with respect to each other so as to provide a different throw with respect to each string when the pivotable member is moved in a pivotable manner.

In greater detail, the tremolo device according to the present invention may be used with an appropriate stringed instrument. The present application will describe the use of the invention in conjunction with a guitar as this is a widely accepted use of the tremolo although it will be understood that other instruments may be utilized.

The tremolo device, as is conventional, includes a housing or frame member which is designed to be attached to the guitar. A conventional means of attachment would be by means of screws.

At one end of the housing there are provided bridge saddles having grooves thereon upon which the strings will ride. Means for adjusting the bridge saddle may be provided.

The present invention provides fine tuners which are arranged to receive one end of the string. Various arrangements may be utilized including the use of an extending pin around which the wire is looped or alternatively, a slot to receive a ball at the end of the string could be employed.

One feature of the present invention is the provision of fine tuners wherein the point of attachment thereto for each string is in a staggered relationship with respect to the focal point of the fine tuner housing. In other words, the distance between the point of attachment of the string and the pivot point of the fine tuner housing is varied to allow for different throws for each string. Means for adjusting the fine tuners are provided.

The fine tuners are mounted on a first rotatable or pivotable member such that a rotatable or pivotable movement in a first direction will cause an increase in tension on the string and a pivotable movement in a second direction will cause a decrease in tension on the string.

The first pivotable member has a cam surface associated therewith. This cam surface has a center point on one side of which the surface extends in a decreasing radius and on the other side of which the surface extends in an increasing radius. This cam surface may either be formed integrally as a portion of the first pivotable member or alternatively, a separate member secured thereto may be employed.

A second pivotable or rotatable member is also provided and this second pivotable member has an arm extending therefrom which is adapted to contact the cam surface of the first pivotable member. The arm extends from the second pivotable member such that when it contacts the cam surface at the center point, it is substantially perpendicular thereto. When the second pivotable member is rotated such that the arm moves along the cam surface in the direction of the decreasing radius, it will exert a force thereon which will in turn translate into a rotatable or pivotable movement on the first pivotable member. Similarly, when it moves in a direction along the cam surface of an increasing radius, it will permit the first pivotable member to move in the opposite direction.

The second pivotable member has springs means associated therewith to assist the return of the arm from the increasing radius to the cam center point surface in the direction of increasing radius. Naturally, various arrangements of spring members may be utilized.

The tremolo device, as taught herein, may have several different variations. Thus, for example, one could use a plurality of such devices, each one being associated with one or more strings. A conventional arrangement provides for a single device although, as mentioned, each string could have its own individual tremolo.

Having thus generally described the invention, reference will be made to the accompanying drawings illustrating an embodiment thereof, in which:

DETAILED DESCRIPTION OF THE INVENTION

In greater detail, the tremolo will be described with reference to a guitar although other instruments may also incorporate such a tremolo. The tremolo includes a frame or housing 10 having a plurality of apertures 12 by means of which the housing 10 may be attached to the guitar by means of suitable screws (not shown). At a front end of housing 10, there are provided a plurality of longitudinally extending slots 14 which are adapted to receive bridge saddles 16. The device illustrated herein is that of a typical guitar and thus, six such bridge saddles 16 are shown.

Figure 6:
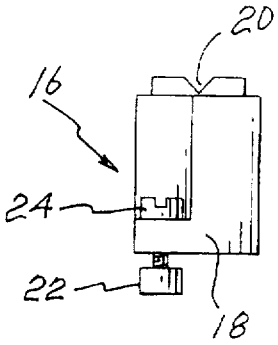
FIG. 6 is a detailed view of a bridge saddle member.
Figure 7:
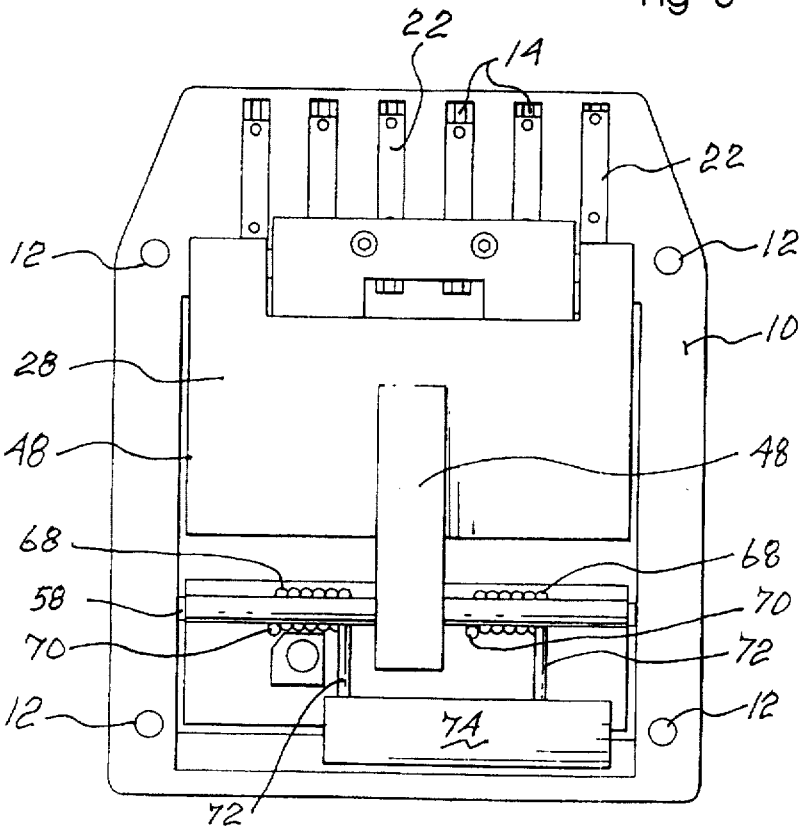
FIG. 7 is a bottom view of the tremolo.

Each bridge saddle 16, as may be seen in FIG. 6, comprises a body 18 with a groove 20 formed in the upper surface thereof. Groove 20 is of a certain size depending on the thickness of the string which it is to receive as is well known in the art. Bridge saddles 16 are mounted in slots 14 and are longitudinally moveable therein. To this end, there is provided a base member 22 for each bridge saddle 18; a pair of threaded members 24 pass through body 18 and are screw threadably engageable with a base member 22. Thus, tightening of the screws 24 will retain the bridge saddle 16 at the desired position within slot 14.

Connected to housing 10 is a downwardly extending frame member 26. Pivotably attached to frame member 26 is a first pivotable member 28 which has a base portion 30, a front wall 32 and a back wall 34. As may be seen from FIG. 2, first pivotable member 28 is secured to and rotatable with respect to frame member 26 by means of a shaft 36.

Figure 1:
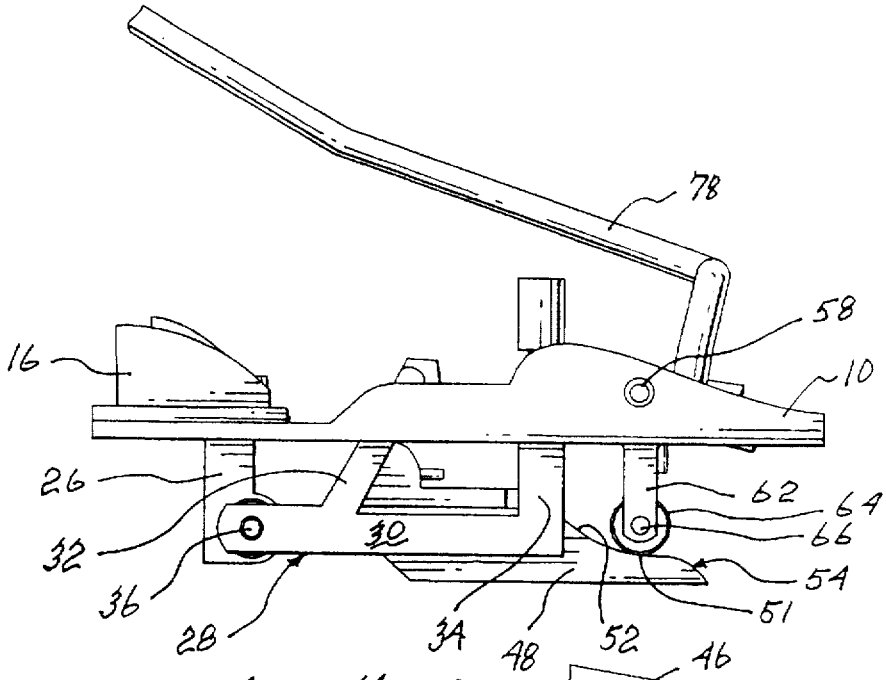
FIG. 1 is a top plan view of one embodiment of a tremolo according to the present invention.
Figure 2:
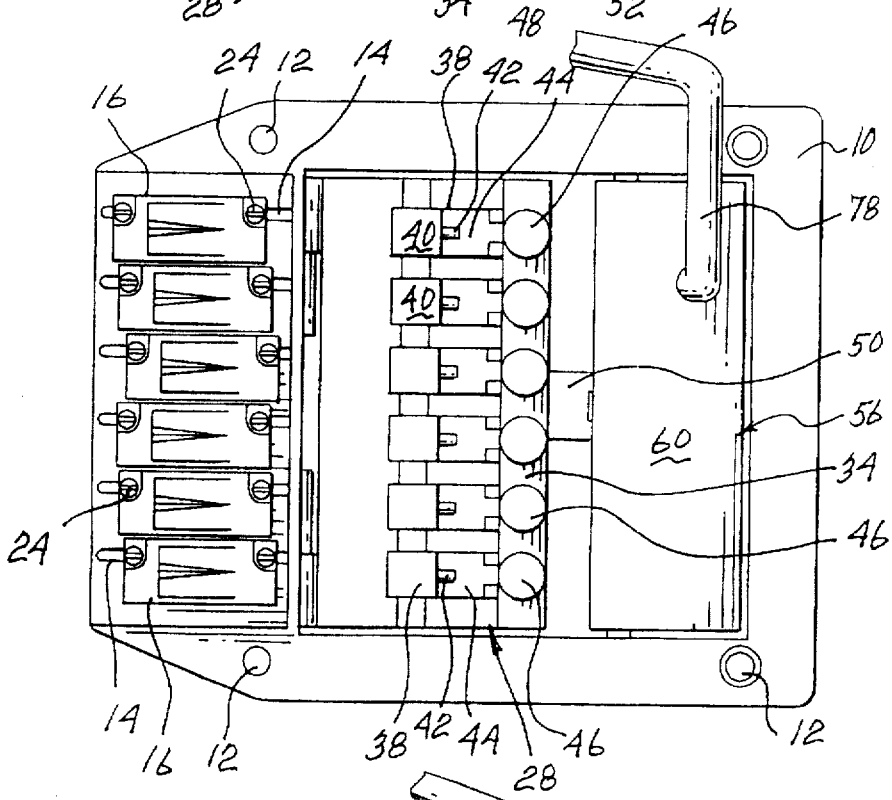
FIG. 2 is a side elevational view thereof.
Figure 3:
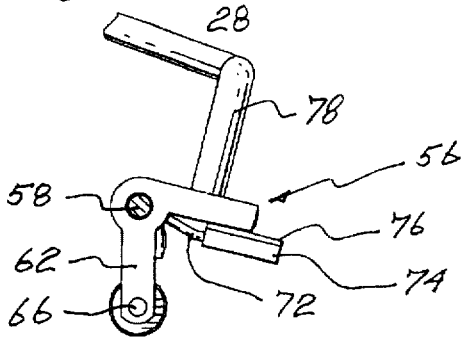
FIG. 3 is a side view illustrating actuation of tremolo lever.
Figure 4:
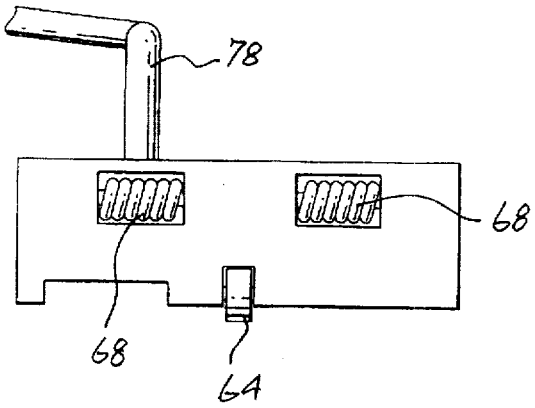
FIG. 4 is a top view of the lever portion illustrated in FIG. 3.
Figure 5:
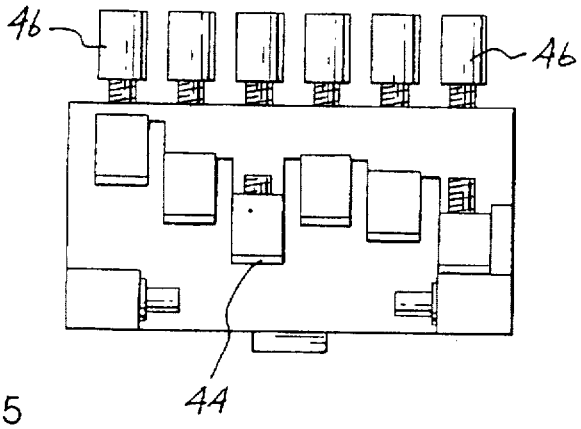
FIG. 5 is a front elevational view of the fine tuner arrangement.

Front wall 32 is adapted to receive a plurality of fine tuners 38. Each fine tuner 38 comprises a body portion 40 which is pivotably mounted between upwardly extending portions of front wall 32 by means of a suitable shaft (not shown). Extending rearwardly from body portion 40 is an outwardly and rearwardly extending pin 42 as shown in FIG. 2 which is adapted to engage and hold one end of musical strings. Extending rearwardly from body portion 40 is an integrally formed tab portion 44 which, as may best be seen from FIG. 5, fits within a slot in back wall 34 and is moveable upwardly and downwardly. An adjustment screw 46 is screw threadably engageable in back wall 34 and extends downwardly into the slot to limit the pivotable movement of the fine tuner 38 to thereby provide the desired adjustment.

It will be noted that the heights of each of the fine tuners 38 are different or in other words, they are in a staggered relationship. The staggered relationship provides the ability to allow for an even pitch descent or ascent on the majority of the strings. In other words, in conventional tremolos, strings are held at approximately the same distance from the fulcrum which does not provide an even chord pitch ascent or descent when using the tremolo since the strings, as previously discussed, require a different throw for an ascent or descent in pitch.

At the end of base 30 remote from its pivot point, there is provided a cam member 48 having a the upper side thereof. Cam member 48 may either be an integral part of base 30 or be a separate member. The surface, has a center point 51 (to be discussed hereinbelow); on one side thereof, the cam surface 50 has an upwardly extending portion 52 and on the other side thereof, has a downwardly extending portion 54.

A second pivotable member 56 is mounted on a shaft 58 which is journalled in housing 10. Second pivotable member 56 has a plate member 60 with an arm 62 extending from its center of rotation along shaft 58. Arm 62 has a roller 64 mounted on the free end thereof by means of a shaft 66.

Mounted on shaft 58 are a pair of torsion springs 68 with first ends 70 thereof being biased against arm 62 and the second end 72 thereof being biased against a plate 74 which is secured to the underside of plate member 60. Plate 74 contacts the underside of housing 10 to limit the movement thereof; on the upper surface of plate 74 there is provided a rubber pad 76 as a contact between plate members 60 and 74.

Extending upwardly from plate member 60 is a lever 78 which is screw threadably engageable therewith and functions as the actuater of the tremolo.

The system functions such that when the tremolo is not used and the instrument is tuned, arm 62 and roller 64 extend so as to contact cam surface 50 at its center point 51. At this point, the forces acting on the system are as follows.

Each strings, attached to a pin 42, passes through groove 20 of bridge saddle 16 and thus, exerts an upward force on each fine tuner 38 to thereby cause a rotation such that tabs 44 would move upwardly. This upward movement is limited by adjustment screw 46 which, as previously mentioned, is mounted in back wall 34. Thus the string tension forces are transferred to first pivotable member 28 and cam member 48 acts to prevent arm 62 from moving to downwardly extending portion 54 of cam surface 50. In this respect, it must be understood that the springs 68 do not act directly on first pivotable member 28, but rather act to maintain arm 62 at the center point 51 of cam surface 50. Thus, in normal operation, the guitar may be operated in a conventional fashion.

When it is desired to operate the tremolo device to increase tension on the strings, handle 78 is moved such that second pivotable member 56 rotates whereby arm 62 will extend onto the upwardly extending portion 52 of cam surface 50. Since this is of a decreasing radius, cam member 48 is forced downwardly causing pivoting of member 28 about shaft 36 and the downward movement of pins 42.

In order to decrease tension on the strings, handle 78 is moved such that arm 62 and roller 64 extends to the downwardly extending portion 54 of cam surface 50. This permits the string tension to act to move cam member 48 upwardly and thereby decrease the tension on the strings.

As will be seen from the above, there are considerable advantages in the arrangement shown. Thus, the strings are not held in a balance with springs directly, but rather by means of the action of arm 62 on cam surface 50. If one or more strings breaks, this results in a decrease in the total force acting on the first pivotable member 28 and would normally cause a corresponding movement and loss of tuning. However, since the second pivotable member 56 utilizes the springs only to maintain arm 62 in the desired position, there is no change or loss of tuning in the strings. Similarly, any increase in tension on the springs does not cause movement of arm 62 and thus, even during certain actions taken by the guitarist, the tuning remains.

It will be understood that the above described embodiment is for purposes of illustration only and that changes and modifications may be made thereto without departing from the spirit and scope of the invention.

What is claimed is:

1. A tremolo device for use with a musical instrument having a plurality of strings, said device comprising a housing, a first pivotable member being rotatably mounted on said housing, string mounting means on said first pivotable member for mounting one end of at least one string thereon such that a pivotable movement in a first direction will cause an increase in tension on said string and a pivotable movement in a second direction will cause a decrease in tension on said string, said first pivotable member having a cam surface associated therewith, said cam surface having a center point, an upwardly extending cam surface portion having a decreasing radius on a first side of said center point and a downwardly extending cam surface portion having an increasing radius on a second side of said center point, a second pivotable member rotatably mounted on said housing, an arm extending outwardly from said second pivotable member and having a free end thereof adapted to contact said cam surface, the arrangement being such that pivotable movement of said second pivotable member will cause said free end of said arm to move along said cam surface to permit pivotable movement of said first pivotable member to thereby cause a change of tension on said string.

2. The device of claim 1 wherein said string mounting means on said first pivotable member comprises means for mounting a plurality of strings.

3. The device of claim 1 wherein said string mounting means includes a fine tuner housing, a plurality of fine tuners, each fine tuner having a point of attachment to receive a string end, each of said fine tuners being mounted on said first pivotable member such that said points of attachment are at staggered distances from a pivot point of said fine tuner housing to thereby provide a different throw for each string.

4. The device of claim 1 wherein said arm has a roller mounted at said free end adapted to contact said cam surface.

5. The device of claim 1 wherein said arm is substantially perpendicular to said cam surface at said center point.

6. The device of claim 5 further including spring means operatively associated with said second pivotable member to urge said second pivotable member into a position where said arm is in a position such that the free end thereof contacts the cam surface at said center point.

7. The device of claim 5 wherein said second pivotable member includes an actuator arm.

8. The device of claim 5 wherein said arm extends outwardly from said second pivotable member at an axis of rotation of said second pivotable member.

* * * * *